US009881549B2

(12) United States Patent
Li et al.

(10) Patent No.: US 9,881,549 B2
(45) Date of Patent: Jan. 30, 2018

(54) OLED PIXEL UNIT AND METHOD OF DRIVING THE SAME, AND OLED DISPLAY DEVICE

(71) Applicant: BOE TECHNOLOGY GROUP CO., LTD., Beijing (CN)

(72) Inventors: Yongqian Li, Beijing (CN); Quanhu Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/912,518

(22) PCT Filed: Sep. 16, 2015

(86) PCT No.: PCT/CN2015/089762
§ 371 (c)(1),
(2) Date: Feb. 17, 2016

(87) PCT Pub. No.: WO2016/138756
PCT Pub. Date: Sep. 9, 2016

(65) Prior Publication Data

US 2017/0018223 A1 Jan. 19, 2017

(30) Foreign Application Priority Data

Mar. 2, 2015 (CN) ..... 2015 1 0093162

(51) Int. Cl.
*G09G 5/10* (2006.01)
*G09G 3/3233* (2016.01)
(Continued)

(52) U.S. Cl.
CPC ..... *G09G 3/3233* (2013.01); *G09G 3/2003* (2013.01); *G09G 3/3258* (2013.01);
(Continued)

(58) Field of Classification Search
CPC ... G09G 2300/0426; G09G 2320/0252; G09G 2320/0646; G09G 3/2003; G09G 3/32; G09G 3/3233; G09G 3/3258
See application file for complete search history.

(56) References Cited

U.S. PATENT DOCUMENTS 8,111,224 B2 2/2012 Park et al.
2005/0242743 A1 11/2005 Kwak
(Continued)

FOREIGN PATENT DOCUMENTS

CN 1670800 A 9/2005
CN 1670804 A 9/2005
(Continued)

OTHER PUBLICATIONS

International Search Report dated Nov. 26, 2015 issued in corresponding International Application No. PCT/CN2015/089762 along with an English translation of the Written Opinion of the International Searching Authority.
(Continued)

*Primary Examiner* — Kumar Patel
*Assistant Examiner* — Insa Sadio
(74) *Attorney, Agent, or Firm* — Nath, Goldberg & Meyer; Joshua B. Goldberg

(57) ABSTRACT

An OLED pixel unit, a method of driving the same and an OLED display device are provided. The OLED pixel unit comprises M driving modules, a light emitting module comprising N light emitting units and a selecting module for performing gating so that the light emitting unit about to emit light in each frame of picture is connected with the corresponding driving module, wherein M<N. The N light emitting units emit N colors of light. Each driving module generates at most one driving current in a frame of picture to drive one light emitting unit to emit light, and at least one
(Continued)

driving module generates the driving current in each of frames of pictures to drive different light emitting units to emit light in the frames of pictures, so that the M driving modules drive the N light emitting units to emit light in n frames of pictures, wherein 2≤n≤N.

19 Claims, 2 Drawing Sheets

(51) Int. Cl.
*G09G 3/20* (2006.01)
*G09G 3/3258* (2016.01)

(52) U.S. Cl.
CPC ..... *G09G 2300/0426* (2013.01); *G09G 2300/0804* (2013.01); *G09G 2300/0819* (2013.01); *G09G 2300/0842* (2013.01); *G09G 2310/0235* (2013.01); *G09G 2320/0252* (2013.01); *G09G 2320/0646* (2013.01)

(56) References Cited

U.S. PATENT DOCUMENTS

2005/0259095 A1* 11/2005 Kwak ..... G09G 3/3233 345/204
2010/0117998 A1* 5/2010 Yamashita ..... G09G 3/3233 345/204

FOREIGN PATENT DOCUMENTS

| | | | |
|---|---|---|---|
| CN | 1716366 | A | 1/2006 |
| CN | 1991951 | A | 7/2007 |
| CN | 101471032 | A | 7/2009 |
| CN | 104599641 | A | 5/2015 |
| WO | 2013/100545 | A1 | 7/2013 |

OTHER PUBLICATIONS

Office Action dated Jul. 13, 2016 issued in corresponding Chinese Application No. 201510093162.9.

* cited by examiner

OLED PIXEL UNIT AND METHOD OF DRIVING THE SAME, AND OLED DISPLAY DEVICE

This is a National Phase Application filed under 35 U.S.C. 371 as a national stage of PCT/CN2015/089762 filed on Sep. 16, 2015, an application claiming the benefit of Chinese Application No. 201510093162.9 filed on Mar. 2, 2015, the content of each of which is hereby incorporated by reference in its entirety.

FIELD OF THE INVENTION

The present invention relates to the field of display technology, and particularly to an OLED pixel unit and a method of driving the same, and an OLED display device.

BACKGROUND OF THE INVENTION

In an OLED display device, each of pixel units generally comprises three subpixels. Each subpixel comprises an OLED that is driven by a driving module to emit a corresponding color of light. The OLED display device allows each pixel unit to display different luminance and colors by controlling parameters such as brightness and color saturation of the light emitted from the OLED in each subpixel.

Generally, the driving module comprises a plurality of transistors and at least one capacitor. FIG. 1 illustrates a driving module that comprises a small number of transistors and a capacitor. As shown in FIG. 1, the driving module comprises a switching transistor T1, a driving transistor M1 and a storage capacitor C1. In the driving module shown in FIG. 1, a current for driving the OLED to emit light is expressed as:

$$I = \frac{\beta}{2}(Vgs - Vth)^2,$$

where Vgs indicates a voltage difference between a gate and a source of the driving transistor M1, β indicates a parameter in connection with a process parameter and a feature size of the driving transistor M1, and Vth indicates a threshold voltage of the driving transistor M1.

Generally, in the existing OLED display device, the OLEDs in the subpixels are driven by individual driving modules and emit light simultaneously. Such a configuration causes the number of the driving modules to be equal to that of the subpixels in each pixel unit, so that the number of the driving modules is relatively large, resulting in that large numbers of transistors, storage capacitors and signal lines are required to be provided in each pixel unit and a large area is occupied by each pixel unit, which counts against improvement of the pixel density of the OLED display device.

SUMMARY OF THE INVENTION

In order to solve at least above technical problem existing in the prior art, embodiments of the present invention provide an OLED pixel unit, a method of driving the OLED pixel unit and an OLED display device, which may reduce the number of the driving modules, thereby reducing the area occupied by each OLED pixel unit, which facilitates improvement of the pixel density of the OLED display device.

An embodiment of the present invention provides an OLED pixel unit, comprising driving modules, a selecting module and a light emitting module. The number of the driving modules is M, the light emitting module comprises N light emitting units, wherein M<N. The N light emitting units emit N colors of light capable of achieving full color display, respectively. Each driving module generates at most one driving current in a frame of picture so as to drive one light emitting unit to emit light, and at least one driving module generates the driving current in each of a plurality of frames of pictures so as to drive different light emitting units to emit light in the plurality of frames of pictures, so that the M driving modules drive the N light emitting units to emit light in n frames of pictures, wherein 2≤n≤N. The selecting module is configured to perform gating so that the light emitting unit about to emit light in each frame of picture is connected with the corresponding driving module.

The plurality of light emitting units may be connected in parallel, and the selecting module may comprise switching devices provided on branches where the respective light emitting units are located.

The switching device may be a thin film transistor, a control electrode of the thin film transistor is connected with a control voltage terminal, and a first electrode and a second electrode of the thin film transistor are connected with the driving module and the light emitting unit, respectively.

The light emitting unit may further be connected with a low voltage terminal.

The light emitting unit may be an OLED.

The number of the driving modules may be one.

The number of the light emitting units may be three.

The three light emitting units may emit red light, green light and blue light, respectively.

Each driving module may comprise a switching transistor, a driving transistor and a storage capacitor. A control electrode of the switching transistor is connected with a gate line, a first electrode of the switching transistor is connected with a data line, and a second electrode of the switching transistor is connected with a control electrode of the driving transistor and a first terminal of the storage capacitor. A first electrode of the driving transistor is connected with a high voltage terminal, and a second electrode of the driving transistor is connected with the selecting module and a second terminal of the storage capacitor.

Another embodiment of the present invention provides a method of driving the above OLED pixel unit. In the method, the driving modules generate N driving currents in the n frames of pictures so as to drive the N light emitting units to emit light, so that the OLED pixel unit displays one pixel in the n frames of pictures, a time interval between a light-emitting time of the first light emitting unit to emit light and a light-emitting time of the last light emitting unit to emit light is controlled to be within a human visual persistence time.

In the method, the number of the driving modules may be one, the driving module generates N driving currents corresponding to the N light emitting units in N frames of pictures, and the driving module is connected with one light emitting unit in each frame of picture through the selecting module so as to drive the light emitting unit to emit light.

In the method, the light emitting module may comprise a red light emitting unit, a green light emitting unit and a blue light emitting unit. In the first frame of picture, the driving module generates a first driving current so as to drive the red light emitting unit to emit red light. In the second frame of picture, the driving module generates a second driving current so as to drive the green light emitting unit to emit green light. In the third frame of picture, the driving module generates a third driving current so as to drive the blue light emitting unit to emit blue light.

Yet another embodiment of the present invention provides an OLED display device, comprising the above OLED pixel unit.

In the OLED pixel unit according to the embodiment of the present invention, at least one of the M driving modules generates the driving current in each of the plurality of frames of pictures, so as to drive different light emitting units to emit light in the plurality of frames of pictures, so that the number of the light emitting units emitting light in each frame of picture is less than N, and the number of the driving modules in the OLED pixel unit may be less than that of the light emitting units. Compared with the prior art, such a configuration reduces the number of the driving modules, which may reduce the area occupied by each OLED pixel unit, thereby facilitating improvement of the pixel density of the OLED display device.

In the method of driving the OLED pixel unit according to the embodiment, at least one driving module generates the driving current in each of the plurality of frames of pictures and drives different light emitting units to emit light in the plurality of frames of pictures, so that the number of the light emitting units emitting light in each frame of picture is less than N, and the number of the driving modules in the OLED pixel unit may be less than that of the light emitting units. Compared with the prior art, such a configuration reduces the number of the driving modules, which may reduce the area occupied by each OLED pixel unit, thereby facilitating improvement of the pixel density of the OLED display device.

The OLED display device according to the embodiment utilizes the above OLED pixel unit, the area occupied by each OLED pixel unit may be reduced, thereby facilitating improvement of the pixel density of the OLED display device.

BRIEF DESCRIPTION OF THE DRAWINGS

The accompanying drawings which constitute a part of the description are used for providing further understanding of the present invention and for explaining the present invention in conjunction with the following specific embodiments, rather than limiting the present invention. In the accompanying drawings.

DESCRIPTION OF THE PREFERRED EMBODIMENT

Hereinafter, specific embodiments of the present invention will be described in detail with reference to the accompanying drawings. It should be understood that the embodiments described herein are only employed for illustrating and explaining the present invention, rather than limiting the present invention.

Figure 1:
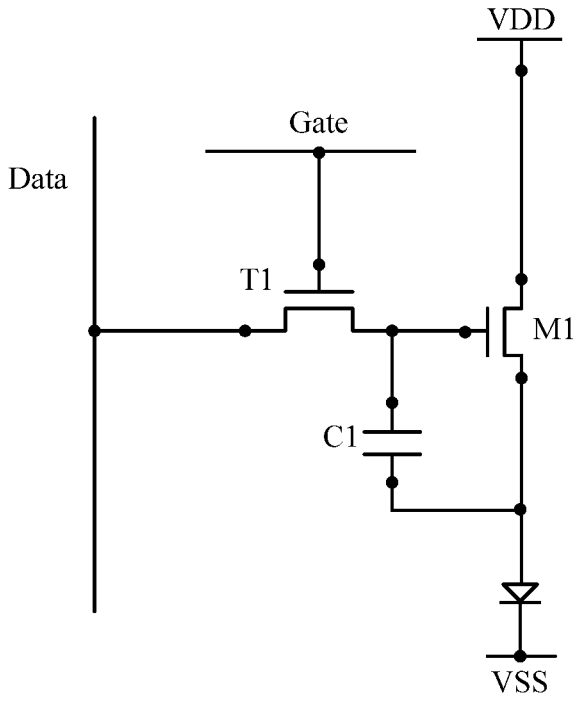
FIG. 1 is a circuit diagram of a driving module in the prior art.
Figure 2:
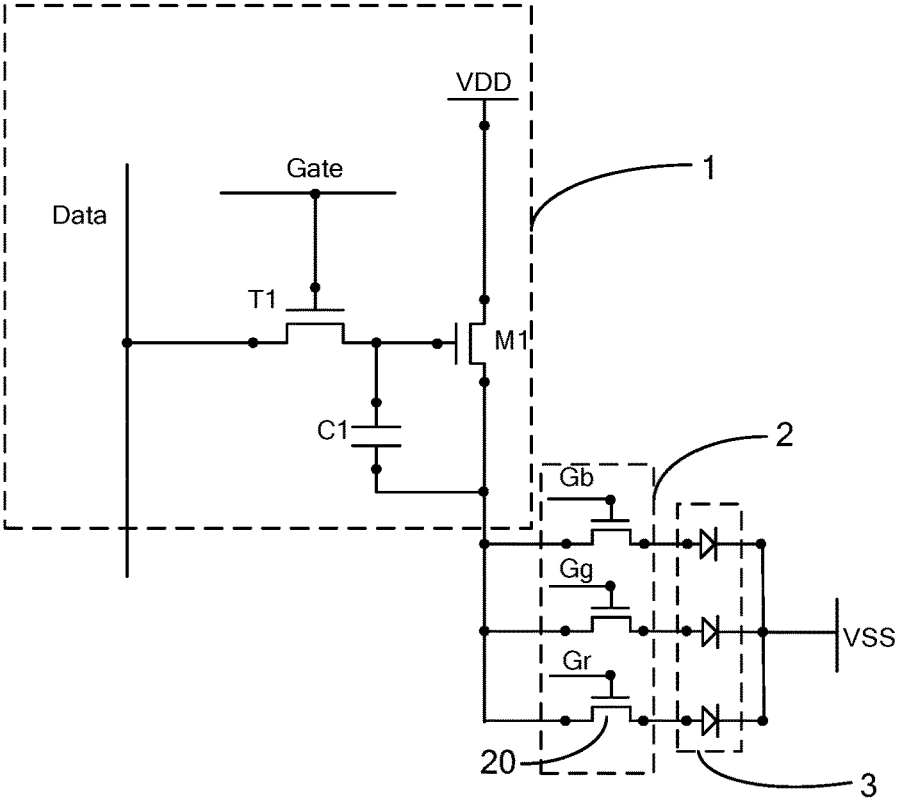
FIG. 2 is a schematic diagram of an OLED pixel unit according to an embodiment of the present invention.

FIG. 2 is a schematic diagram of an OLED (organic light emitting diode) pixel unit according to an embodiment of the present invention. As shown in FIG. 2, in the present embodiment, the OLED pixel unit comprises a driving module 1, a selecting module 2 and a light emitting module 3. The OLED pixel unit of the embodiment comprises one driving module 1, the light emitting module 3 comprises three light emitting units for emitting three colors of light capable of achieving full color display (e.g., red light, green light and blue light), the light emitting unit is an OLED. The driving module 1 generates a driving current in a frame of picture, so as to drive one light emitting unit to emit light, and the selecting module 2 is configured to perform gating so that the light emitting unit about to emit light in each frame of picture is connected with the driving module 1. In the embodiment, one driving module is provided for three light emitting units, and light emissions of three light emitting units constituting one pixel are completed in three frames of pictures. Compared with the prior art, the number of the driving modules 1 in each OLED pixel unit may be reduced in the embodiment, which facilitates improvement of the pixel density of the OLED display device.

It should be understood that, the OLED pixel unit of the present invention is not limited to the embodiment shown in FIG. 2, the OLED pixel unit may comprise M driving modules 1, the light emitting module 3 may comprise N light emitting units, the light emitting module may be an OLED, wherein $M<N$. The N light emitting units emit N colors of light capable of achieving full color display, respectively. Each driving module 1 generates at most one driving current in a frame of picture so as to drive one light emitting unit to emit light, and at least one driving module 1 generates the driving current in each of a plurality of frames of pictures so as to drive different light emitting units to emit light in the plurality of frames of pictures, so that the M driving modules 1 drive the N light emitting units to emit light in n frames of pictures, wherein $2 \leq n \leq N$. The selecting module 2 is configured to perform gating so that the light emitting unit about to emit light in each frame of picture is connected with the driving module 1.

In the OLED pixel unit of the embodiment, $M<N$, i.e., the number of the driving modules 1 is smaller than that of the light emitting units included in the light emitting module 3. Compared with the prior art, the number of the driving modules 1 in the OLED pixel unit of the embodiment is smaller, so that the area occupied by each OLED pixel unit may be reduced, which facilitates improvement of the pixel density of the OLED display device.

Specifically, in the embodiment, at least one driving module 1 generates the driving current in each of the plurality of frames of pictures to drive different light emitting units to emit light in the plurality of frames of pictures, thereby allowing the M driving modules generate N driving currents in the n frames of pictures so as to drive the N light emitting units to emit light, i.e., achieving a technical solution in which the N light emitting units are driven by the M driving modules 1 so that the OLED pixel unit displays N color components of one pixel in the n frames of pictures. For example, when N=3 and M=2, one of two driving modules 1 is configured to generate the driving current in each of two frames of pictures so as to drive two light emitting units to emit light in the two frames of pictures, while the other driving module 1 may generate the driving current in the first frame of picture to drive another light emitting unit to emit light, and may not generate the driving current in the second frame of picture (alternatively, the other driving module 1 may generate the driving current in the second frame of picture, and may not generate the driving current in the first frame of picture).

In the embodiment, the OLED pixel unit displays one pixel through the n frames of picture. Therefore, compared with the technical solution of displaying one pixel in one frame of picture in the prior art, the OLED display device using the OLED pixel unit provided in the embodiment displays less frames of pictures when refresh rates of the display devices are equal. In this case, the refresh rate of the OLED display device may be increased to display more frames of pictures per unit time.

In the prior art, in one frame of picture, the light emitting units in the OLED pixel unit are driven by respective corresponding driving modules to emit light simultaneously, so that each OLED pixel unit displays corresponding color and luminance.

However, in the present embodiment, the light emissions of the N light emitting units in the OLED pixel unit are completed in the n frames of pictures, wherein $2 \leq n \leq N$. It could be understood that, in this case, if an image seen by a viewer has a corresponding color presented after mixing of various colors of light emitted from the plurality of light emitting units, rather than colors of light individually emitted from the respective light emitting units, a time interval between light-emitting time of the first light emitting unit to emit light and light-emitting time of the last light emitting unit to emit light should be less than human visual persistence time.

It is known that, the OLED display device is different from the liquid crystal display device (LCD). In the LCD, each subpixel requires relatively long response time to display corresponding luminance. In the OLED display device, a response speed of light emission of the OLED is relatively high. In this case, in the OLED pixel unit of the embodiment, the time interval between the light-emitting time of the first light emitting unit to emit light and the light-emitting time of the last light emitting unit to emit light may be controlled within the human visual persistence time, so that the displayed image of the OLED pixel unit seen by the viewer has the corresponding color presented after mixing of various colors of light emitted from the plurality of light emitting units, rather than the colors of light individually emitted from the respective light emitting units.

For example, as shown in FIG. 2, the number of the driving modules 1 is one, such a configuration reduces the number of the driving modules 1 to the utmost extent and reduces the area occupied by each OLED pixel unit to the utmost extent, thereby improving the pixel density of the OLED display device to the utmost extent. In this case, the driving module 1 requires N frames of pictures to generate N driving currents, so as to drive N light emitting units to emit light, so that only by the N frames of pictures, can the OLED pixel unit display N color components of one pixel.

As shown in FIG. 2, the plurality of light emitting units are connected in parallel, and a switching device 20 is provided on a branch where each light emitting unit is located. The selecting module 2 comprises the switching devices 20 provided on the branches where the respective light emitting units are located. For example, the switching device 20 may be a thin film transistor, in this case, a control electrode of the thin film transistor is connected with a control voltage terminal, and a first electrode and a second electrode of the thin film transistor are connected with the driving module 1 and the light emitting unit, respectively.

In the embodiment, it is noted that the control electrodes of the thin film transistor described above and the transistors described later are gates, the first electrodes thereof are sources, and the second electrodes thereof are drains.

Generally, the number of the light emitting units in the OLED pixel unit is three, and the light emitting units emit red light, green light and blue light, respectively.

Figure 3:
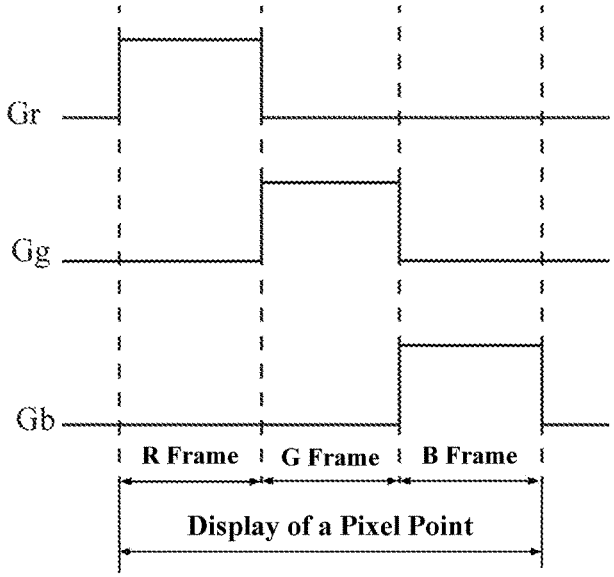
FIG. 3 is a timing diagram of control signals for allowing light emitting units in an OLED pixel unit to emit light according to an embodiment of the present invention.

Hereinafter, a principle and a procedure of achieving display by the OLED pixel unit according to the embodiment will be described in detail by taking an example in which the OLED pixel unit comprises one driving module 1 and the light emitting module 3 comprises three light emitting units (respectively emitting the red light, the green light and the blue light) with reference to a timing diagram of a control signal shown in FIG. 3.

Firstly, in a first frame of picture (R frame), the driving module 1 generates a first driving current, and meanwhile, the thin film transistor provided on the branch where the light emitting unit emitting the red light is located is turned on under the control of the control voltage terminal Gr, the first driving current is input into the light emitting unit emitting the red light so as to drive the light emitting unit to emit the red light.

Subsequently, in a second frame of picture (G frame), the driving module 1 generates a second driving current, and meanwhile, the thin film transistor provided on the branch where the light emitting unit emitting the green light is located is turned on under the control of the control voltage terminal Gg, the second driving current is input into the light emitting unit emitting the green light so as to drive the light emitting unit to emit the green light.

Next, in a third frame of picture (B frame), the driving module 1 generates a third driving current, and meanwhile, the thin film transistor provided on the branch where the light emitting unit emitting the blue light is located is turned on under the control of the control voltage terminal Gb, the third driving current is input into the light emitting unit emitting the blue light so as to drive the light emitting unit to emit the blue light.

In above procedure, the time interval between the time of the first light emitting unit to emit the red light and the time of the last light emitting unit to emit the blue light is controlled to be within the human visual persistence time, so that the viewer sees the color of light after mixing of the red light, the green light and the blue light emitted from the respective light emitting units.

Specifically, as shown in FIG. 2, each driving module 1 may comprise a switching transistor T1, a driving transistor M1 and a storage capacitor C1. The control electrode of the switching transistor T1 is connected with a gate line Gate, the first electrode of the switching transistor T1 is connected with a data line Data, and the second electrode of the switching transistor T1 is connected with the control electrode of the driving transistor M1 and a first terminal of the storage capacitor C1. The first electrode of the driving transistor M1 is connected with a high voltage terminal VDD, and the second electrode of the driving transistor M1 is connected with the selecting module 2 and a second terminal of the storage capacitor C1. Each light emitting unit is also connected with a low voltage terminal VSS.

Specifically, during a procedure of generating the driving currents by the driving module 1 shown in FIG. 2 (i.e., every frame of picture), a high-level signal is first input from the gate line Gate so that the switching transistor T1 is turned on, and in this case, the data line Data charges the control electrode of the driving transistor M1 and the first terminal of the storage capacitor C1, so that the voltages thereof become Vdata. Subsequently, a low-level signal is input from the gate line Gate so that the switching transistor T1 is turned off, the voltage stored in the storage capacitor C1 allows the voltage of the control electrode of the driving transistor M1 to be maintained at Vdata and allows the driving transistor M1 to be turned on, so as to generate the driving current according to the voltages of the control electrode and the first electrode of the driving transistor M1, the driving current I may be expressed by the following equation:

$$I=K(Vgs-Vth)^2=K(V\text{data}-VDD-Vth)^2.$$

While the above driving current is generated, the thin film transistor provided on the branch where one light emitting unit is located is turned on, so that the driving current may drive the light emitting unit to emit the corresponding color of light.

It should be noted that, in the embodiment, the structure of the driving module 1 is not limited to the structure of 2T1C (i.e., two transistors and one storage capacitor) shown in FIG. 2, the structure may also be any structure capable of driving the light emitting unit to emit light (e.g., a driving structure comprising more transistors and/or more storage capacitors).

In the OLED pixel unit according to the embodiment of the present invention, at least one of the M driving modules 1 generates the driving current in each of the plurality of frames of pictures, so as to drive different light emitting units to emit light in the plurality of frames of pictures, so that the number of the light emitting units emitting light in each frame of picture is less than N, and the number of the driving modules 1 in the OLED pixel unit may be less than that of the light emitting units. Compared with the prior art, such a configuration reduces the number of the driving modules 1, which may reduce the area occupied by each OLED pixel unit, thereby facilitating improvement of the pixel density of the OLED display device.

Another embodiment of the present invention provides a driving method of an OLED pixel unit, for driving the OLED pixel unit of the above embodiment of the present invention. In the embodiment, the driving modules generate N driving currents in n frames of pictures to drive N light emitting units to emit light, so that the OLED pixel unit displays one pixel in the n frames of pictures. In the driving method, at least one driving module generates the driving current in each of the plurality of frames of pictures, for driving different light emitting units to emit light in the plurality of frames of pictures.

In the driving method of the OLED pixel unit according to the embodiment, at least one driving module generates the driving current in each of the plurality of frames of pictures and drives different light emitting units to emit light in the plurality of frames of pictures, so that the number of the light emitting units emitting light in each frame of picture is less than N, and the number of the driving modules in the OLED pixel unit may be less than that of the light emitting units. Compared with the prior art, such a configuration reduces the number of the driving modules, which may reduce the area occupied by each OLED pixel unit, thereby facilitating improvement of the pixel density of the OLED display device.

For example, the number of the driving modules in the OLED pixel unit is one, and in this case, the driving module generates N driving currents corresponding to N light emitting units in N frames of pictures, and the driving module is connected with one light emitting unit in each frame of picture through the selecting module so as to drive the light emitting unit to emit light. Such a configuration reduces the number of the driving modules to the utmost extent, and reduces the area occupied by each OLED pixel unit to the utmost extent, thereby improving the pixel density of the OLED display device to the utmost extent.

Another embodiment of the present invention provides an OLED display device. In the embodiment, the OLED display device comprises the OLED pixel unit of the above embodiment of the present invention.

The OLED display device according to the embodiment utilizes the OLED pixel unit of the above embodiment of the present invention, the area occupied by each OLED pixel unit may be reduced, thereby facilitating improvement of the pixel density of the OLED display device.

It should be understood that the above embodiments are only exemplary embodiments for illustrating the principle of the present invention, but the present invention is not limited thereto. Various variations and improvements can be made by the person of ordinary skill in the art without departing from the spirit and essence of the present invention, and these variations and improvements should also be considered to fall within the protection scope of the present invention.

What is claimed is:

1. An OLED pixel unit, comprising a selecting module, a light emitting module and M drivers, wherein the light emitting module comprises N light emitting units, wherein M<N;

the N light emitting units emit N colors of light capable of achieving full color display, respectively;

each driver generates at most one driving current in a frame of picture so as to drive one light emitting unit to emit light, and at least one driver generates the driving current in each of a plurality of frames of pictures so as to drive different light emitting units to emit light in the plurality of frames of pictures, so that the M drivers drive the N light emitting units to emit light in n frames of pictures, wherein $2 \leq n \leq N$, so that the OLED pixel unit displays one pixel in the n frames of pictures;

the selecting module is configured to perform gating so that the light emitting unit about to emit light in each frame of picture is connected with the corresponding driver, wherein the selecting module comprises switching devices provided on branches where the respective light emitting units are located; and wherein a time interval between a light-emitting time of the first light emitting unit to emit light and a light-emitting time of the last light emitting unit to emit light is controlled to be within a human visual persistence time.

2. The OLED pixel unit of claim 1, wherein the plurality of light emitting units are connected in parallel.

3. The OLED pixel unit of claim 2, wherein the switching device is a thin film transistor, a control electrode of the thin film transistor is connected with a control voltage terminal, and a first electrode and a second electrode of the thin film transistor are connected with the driver and the light emitting unit, respectively.

4. The OLED pixel unit of claim 3, wherein the light emitting unit is further connected with a low voltage terminal.

5. The OLED pixel unit of claim 1, wherein the light emitting unit comprises an OLED.

6. The OLED pixel unit of claim 1, wherein the number of the drivers is one.

7. The OLED pixel unit of claim 1, wherein the number of the light emitting units is three.

8. The OLED pixel unit of claim 7, wherein the three light emitting units emit red light, green light and blue light, respectively.

9. The OLED pixel unit of claim 1, wherein each driver comprises a switching transistor, a driving transistor and a storage capacitor, a control electrode of the switching transistor is connected with a gate line, a first electrode of the switching transistor is connected with a data line, and a second electrode of the switching transistor is connected with a control electrode of the driving transistor and a first terminal of the storage capacitor, a first electrode of the driving transistor is connected with a high voltage terminal, and a second electrode of the driving transistor is connected with the selecting module and a second terminal of the storage capacitor.

10. The method of claim 1, wherein the number of the drivers is one, the driver generates N driving currents corresponding to the N light emitting units in N frames of pictures, and the driver is connected with one light emitting unit in each frame of picture through the selecting module so as to drive the light emitting unit to emit light.

11. The method of claim 10, wherein the light emitting module comprises a red light emitting unit, a green light emitting unit and a blue light emitting unit, the driver generates a first driving current so as to drive the red light emitting unit to emit red light in the first frame of picture, the driver generates a second driving current so as to drive the green light emitting unit to emit green light in the second frame of picture, and the driver generates a third driving current so as to drive the blue light emitting unit to emit blue light in the third frame of picture.

12. An OLED display device, comprising OLED pixel units, the OLED pixel unit comprising a selecting module, a light emitting module and drivers, wherein the light emitting module comprises N light emitting units, wherein $M<N$;

the N light emitting units emit N colors of light capable of achieving full color display, respectively;

each driver generates at most one driving current in a frame of picture so as to drive one light emitting unit to emit light, and at least one driver generates the driving current in each of a plurality of frames of pictures so as to drive different light emitting units to emit light in the plurality of frames of pictures, so that the M drivers drive the N light emitting units to emit light in n frames of pictures, wherein $2 \leq n \leq N$ so that the OLED pixel units each display one pixel in the n frames of pictures;

the selecting module is configured to perform gating so that the light emitting unit about to emit light in each frame of picture is connected with the driver, wherein the selecting module comprises switching devices provided on branches where the respective light emitting units are located; and wherein a time interval between a light-emitting time of the first light emitting unit to emit light and a light-emitting time of the last light emitting unit to emit light is controlled to be within a human visual persistence time.

13. The OLED display device of claim 12, wherein the plurality of light emitting units are connected in parallel.

14. The OLED display device of claim 13, wherein the switching device is a thin film transistor, a control electrode of the thin film transistor is connected with a control voltage terminal, and a first electrode and a second electrode of the thin film transistor are connected with the driver and the light emitting unit, respectively.

15. The OLED display device of claim 14, wherein the light emitting unit is further connected with a low voltage terminal.

16. The OLED display device of claim 12, wherein the light emitting unit comprises an OLED.

17. The OLED display device of claim 12, wherein the number of the drivers is one.

18. The OLED display device of claim 12, wherein the number of the light emitting units is three, and the three light emitting units emit red light, green light and blue light, respectively.

19. The OLED display device of claim 12, wherein each driver comprises a switching transistor, a driving transistor and a storage capacitor, a control electrode of the switching transistor is connected with a gate line, a first electrode of the switching transistor is connected with a data line, and a second electrode of the switching transistor is connected with a control electrode of the driving transistor and a first terminal of the storage capacitor, a first electrode of the driving transistor is connected with a high voltage terminal, and a second electrode of the driving transistor is connected with the selecting module and a second terminal of the storage capacitor.

* * * * *